United States Patent [19]

Stromback

[11] 4,295,648

[45] Oct. 20, 1981

[54] BASEBALL PITCHER'S TARGET

[76] Inventor: Theodore D. Stromback, 20000 Delaware Ave., Detroit, Mich. 48240

[21] Appl. No.: 962,925

[22] Filed: Nov. 22, 1978

[51] Int. Cl.[3] ..... A63B 61/00

[52] U.S. Cl. ..... 273/26 A; 273/402

[58] Field of Search ..... 273/26 A, 102 R, 55 R, 273/176 B, 181 A, 35 R, 185, 98, 99, 102 S, 102.1 C, 402, 387, 388, 389, 181 R, 26 E

[56] References Cited

U.S. PATENT DOCUMENTS

| | | | |
|---|---|---|---|
| 708,569 | 9/1902 | Manley | 273/26 A |
| 1,554,409 | 9/1925 | Coffee | 273/26 E |
| 1,592,005 | 7/1926 | Rovane | 273/26 A |
| 2,059,365 | 11/1936 | King | 273/26 A |
| 2,126,102 | 8/1938 | Fowler | 273/26 A |
| 2,873,969 | 2/1959 | Ziel | 273/181 A X |
| 3,312,467 | 4/1967 | Dawson | 273/26 A |
| 3,583,703 | 6/1971 | Brown | 273/26 A |
| 3,820,787 | 6/1974 | Heinbinger | 273/55 B |
| 3,948,517 | 4/1976 | Feiler | 273/29 A |

*Primary Examiner*—Richard C. Pinkham
*Assistant Examiner*—T. Brown

[57] ABSTRACT

A portable baseball pitcher's target for use as a game or practice device wherein the members thereof may be readily assembled and disassembled. A pair of cross-members are slideable on a pair of vertical members to simulate strike zones for a range of baseball batter sizes. A disc shaped target is suspended within the strike zone and may be repositioned therein to designate a particular area of the strike zone.

5 Claims, 5 Drawing Figures

BASEBALL PITCHER'S TARGET

BACKGROUND OF THE INVENTION

Baseball pitcher's targets have hitherto existed in the art for game devices or improvement of a pitcher's skills. These targets have not met widespread acceptance in proportion to the popularity of the sport for a variety of reasons, including, cost, complexity and lack of utility.

It is an object of the present invention to provide a pitcher's target which is moderately priced and particularly oriented towards the younger players, such as, the members of the Little Leagues.

It is another object to provide a portable target which can be readily assembled and disassembled.

It is yet another object to provide a target which may be easily adjusted to simulate a strike zone for a range of baseball batter sizes.

It is still yet another object to provide a target with increased utility by providing a means of designating a particular area within the strike zone, such as, the inside and outside corners.

The foregoing objects, along with additional objects, features, advantages and benefits of the invention become more apparent in the ensuing description and accompanying drawings which disclose the invention in detail. A preferred embodiment is disclosed in accordance with the best mode presently contemplated in carrying out the invention. The subject matter in which an exclusive property right is claimed is set forth in each of the numbered claims at the conclusion of the description, and such subject matter is considered patentable over the prior art of which the applicant is aware, as set forth in the following Prior Art Statement.

PRIOR ART STATEMENT

A novelty search performed in connection with the present invention developed the following U.S. Pat. Nos.: 708,569; 1,592,005; 2,059,365; 2,126,102 and 3,583,703.

U.S. Pat. No. 708,569 discloses a device suspended from an overhead wire wherein a pair of vertical support members is used in combination with a pair of horizontal members to indicate whether a pitched ball is within the strike zone. The strike zone is not adjustable and no means are provided for designating a particular area within the zone.

U.S. Pat. No. 1,592,005 discloses a practice guide for baseball pitchers having a pair of vertical members in combination with a pair of horizontal members wherein a series of holes are provided on the vertical members to allow a user to adjust the height of a strike zone.

U.S. Pat. No. 2,059,365 discloses a baseball pitcher's practice device wherein the figure of a batter is provided on a screen to indicate the strike zone and a series of openings is provided in the screen to designate particular areas of the strike zone.

U.S. Pat. No. 2,126,102 discloses a baseball pitching target having a fixed strike zone corresponding to an average size man wherein particular areas of the zone are designated by dividing the area thereof into five open spaces.

U.S. Pat. No. 3,583,703 discloses a practice pitching device having a fixed average strike zone divided into four separate areas. The strike zone is constructed by connecting a string to a tubular frame and a series of hooks and may be varied in size by optional length strings.

This Prior Art Statement is furnished in compliance with the applicant's duty of disclosure as defined in the Patent and Trademark Office rules for patent cases.

DESCRIPTION OF THE PREFERRED EMBODIMENT

Figure 1:
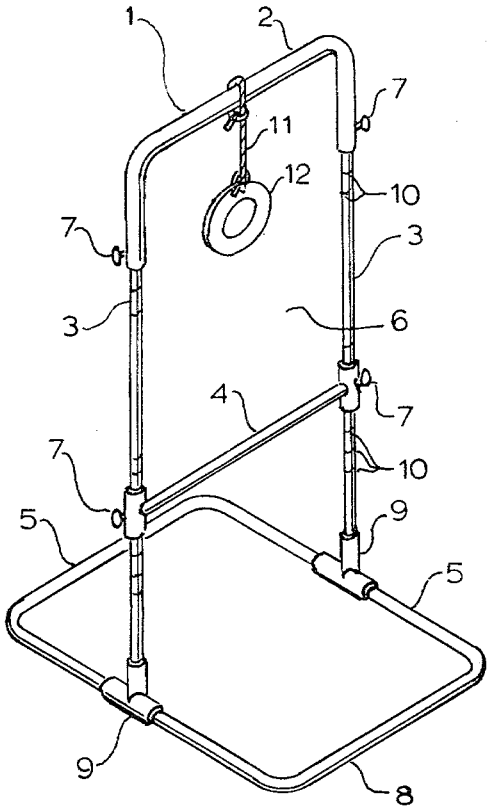
FIG. 1 is a perspective view showing the general appearance of the present invention.
Figure 2:
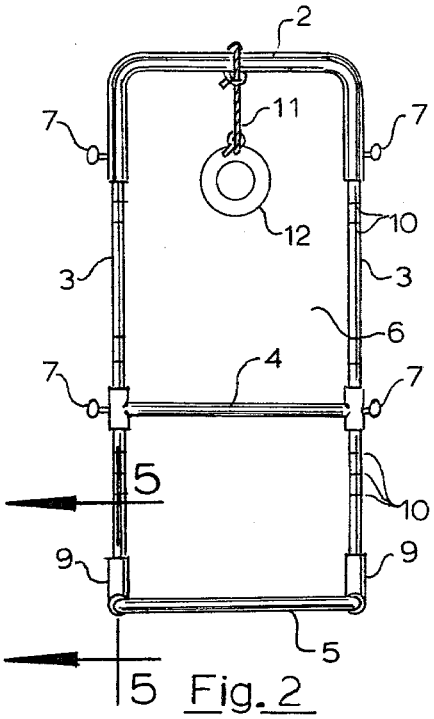
FIG. 2 is a front view of the present invention.
Figure 3:
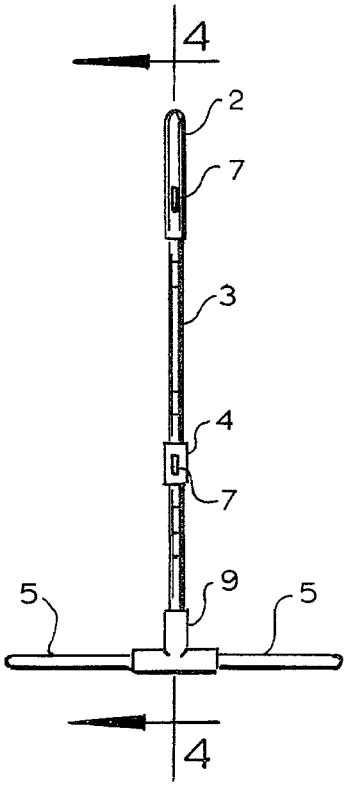
FIG. 3 is a side view of the present invention.
Figure 4:
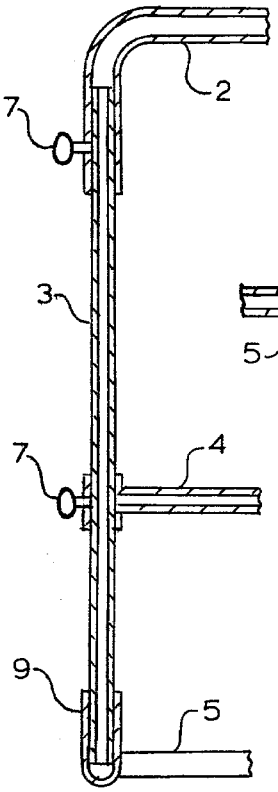
FIG. 4 is a partial sectional view, drawn to an enlarged scale, taken in the direction of arrows 4—4 in FIG. 3.
Figure 5:
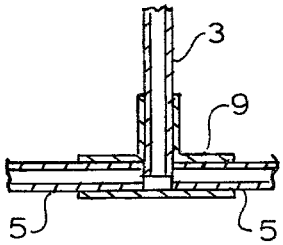
FIG. 5 is a partial sectional view, drawn to an enlarged scale, taken in the direction of arrows 5—5 in FIG. 2.

The preferred embodiment 1 of the present invention is illustrated in the accompanying drawings wherein like numerals refer to parts having an identical construction. In FIG. 1, the embodiment is generally shown as having a pair of vertical tubular members 3 whose end portions engage a support means 8. Extending across the vertical members 3 are an upper crossmember 2 and a lower crossmember 4.

The area bounded by vertical members and the crossmembers 2 and 4 corresponds to the strike zone of a baseball batter and is designated by the numeral 6. The height of zone 6 may be varied to represent a range of batter sizes by sliding crossmembers 2 and 4 at their attachments to the vertical members 3. Marks 10 are provided on vertical members 3 to indicate the proper positions of crossmembers 2 and 4 for corresponding batter sizes.

The upper crossmember 2, a tubular member, is formed with downward end portions which engage the upper end portions of the vertical members 3. Extending transversely through each of the downward extending end portions of crossmember 2 and in threadable engagement thereof is a thumbscrew 7. The thumbscrews 7 bear against the surfaces of vertical members 3 and retain the crossmember 2 in a desired position. The lower crossmember 4, also a tubular member, with vertical end portions, is retained to vertical members 3 in a similar manner to upper crossmember 2 by thumbscrews 7.

The support means 8 is comprised of a pair of T connectors 9, the vertical portions thereof engaged with the lower end portions of members 3 and a pair of U shaped tubular members 5 which engage the horizontal portions of the T connectors 9. It is contemplated that vertical members 3 and base members 5 may be retained to the T connectors 9 by a light interference fit. Optionally, additional retention may be provided by the use of thumbscrews, in the manner indicated for retention of crossmembers 2 and 4 to vertical members 3.

Within the strike zone 6 of the preferred embodiment 1 is suspended a circular target 12. The target 12 which is ancillary to the strike zone 6 is supported by a cord 11 which is attached by a simple knot to the target 12 and upper crossmember 2. Target 12 can be repositioned within the zone 6 by moving its point of attachment to member 2 and lengthening or shortening cord 11, for the purpose of designating a particular area of the zone 6, such as, the inside or outside corner.

While a single embodiment of my invention has been shown, it will be appreciated that other embodiments drawing from individual features of my invention can be provided. For example, a baseball pitcher's target based on the same inventive concept can be constructed having an upper crossmember which is identical in construction to the lower crossmember 4 which I have shown.

Having now described my invention and the manner of making and using it, one can see that what has been accomplished is a portable baseball pitcher's target which is readily assembled and disassembled, is adjustable for representing a range of batter sizes and provides further utility by allowing the designation of a particular area within the strike zone.

What I claim is new is:

1. A portable baseball pitcher's target for use as a game or practice device whereby said device may be readily assembled and adjusted comprising: a pair of vertical members spaced apart in fixed relationship to each other so that the distance between said members corresponds to the width of a baseball batter's strike zone; a pair of crossmembers spaced apart and extending across the vertical members with the end portions of at least one of the crossmembers in slideable engagement with the vertical members so that the vertical distance between the crossmembers corresponds to the height of said strike zone and may be adjusted for a range of batter sizes; a means for locking the ends of said crossmembers to said vertical members; a target suspended within the strike zone bounded by said vertical members and said crossmembers whereby a particular area of said zone may be designated, a means for suspending the target within the strike zone comprising a cord having one end portion thereof attached to the target and the other end portion attached to one of the crossmembers whereby the target may be repositioned within the strike zone by varying the length of said cord and the point of attachment to said crossmember; and a means for supporting said vertical members to which the lower end portions of vertical members thereof are attached.

2. The portable baseball pitcher's target as described in claim 1 wherein the target suspended within the strike zone has a circular shape.

3. The portable baseball pitcher's target as described in claim 1 wherein markers are provided on said vertical members to indicate the positions of said slideable crossmember corresponding to the heights of the strike zones for a range of batter sizes.

4. The portable baseball pitcher's target as described in claim 1 wherein the means for supporting said vertical members comprises a rectangular shaped tubular base to which the lower end portions of said vertical members are attached.

5. A portable baseball pitcher's target for use as a game or practice device whereby said device may be readily assembled and adjusted comprising: a pair of vertical members spaced apart in fixed relationship to each other so that the distance between said members corresponds to the width of a baseball batter's strike zone; a pair of crossmembers spaced apart and extending across the vertical members with the end portions of both of the crossmembers in slideable engagement with the vertical members so that the vertical distance between the crossmembers corresponds to the height of said strike zone and may be adjusted for a range of batter sizes; markers on said vertical members to indicate the positions of said slideable crossmembers corresponding to the heights of the strike zone for a range of batter sizes; a means for locking the ends of said slideable crossmembers to said vertical members; a circular target suspended within the strike zone bounded by said vertical members and said crossmembers whereby a particular area of said zone may be designated; a cord having one end portion thereof attached to the target and the other end portion attached to one of the crossmembers whereby the target may be repositioned within the zone by varying the length of said cord and the point of attachment thereof to said crossmember; and a rectangular shaped tubular base to which the lower end portions of said vertical members are attached.

* * * * *